US006656891B1

(12) United States Patent
Sakanoue et al.

(10) Patent No.: US 6,656,891 B1
(45) **Date of Patent: *Dec. 2, 2003**

(54) REFRIGERATING MACHINE OIL COMPOSITION

(75) Inventors: Shuichi Sakanoue, Ichihara (JP); Masahiko Takesue, Ichihara (JP); Minoru Takagi, Tokyo (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/674,497

(22) PCT Filed: May 12, 1999

(86) PCT No.: PCT/JP99/02449

§ 371 (c)(1),
(2), (4) Date: Nov. 13, 2000

(87) PCT Pub. No.: WO99/58628

PCT Pub. Date: Nov. 18, 1999

(30) Foreign Application Priority Data

May 13, 1998 (JP) ..... 10/130800

(51) Int. Cl.[7] ..... C10M 145/22; C10M 145/26; C09K 5/00

(52) U.S. Cl. ..... 508/579; 252/67; 252/68; 508/485

(58) Field of Search ..... 252/67, 68; 508/579, 508/485

(56) References Cited

U.S. PATENT DOCUMENTS

| | | | | | |
|---|---|---|---|---|---|
| 5,445,753 | A | * | 8/1995 | Fukuda et al. | 252/68 |
| 5,520,833 | A | * | 5/1996 | Kaneko | 252/68 |
| 5,553,465 | A | * | 9/1996 | Fukuda et al. | 252/68 |
| 6,013,609 | A | * | 1/2000 | Katafuchi | 508/206 |
| 6,193,906 | B1 | * | 2/2001 | Kaneko et al. | 508/579 |
| 6,251,300 | B1 | * | 6/2001 | Takigawa et al. | 252/67 |

FOREIGN PATENT DOCUMENTS

| | | | |
|---|---|---|---|
| JP | 10102079 | * | 4/1998 |

* cited by examiner

*Primary Examiner*—Jacqueline V. Howard
(74) *Attorney, Agent, or Firm*—Oblon, Spivak, McClelland, Maier & Neustadt, P.C.

(57) ABSTRACT

The invention provides a refrigerating machine oil composition by which a capillary tube is hardly clogged when a hydrofluorocarbon type, a hydrocarbon type, an ether type, a carbon dioxide type or an ammonia type is used as a refrigerant. It is a refrigerating machine oil composition in which base oil containing at least one oxygen-containing synthetic oil selected from a polyvinyl ether and a polyol ester is mixed with 1 to 20% by weight, based on the total amount of the composition, of a specific polyalkylene glycol alkyl ether or 1 to 40% by weight, based on the total amount of the composition, of an alkylbenzene having a number average molecular weight of 100 to 1,000.

5 Claims, No Drawings

REFRIGERATING MACHINE OIL COMPOSITION

This application is a 371 of PCT/SP99/02449 filed May 12, 1999.

TECHNICAL FIELD

The present invention relates to a refrigerating machine oil composition. More specifically, it relates to a refrigerating machine oil composition having good properties that a capillary tube is hardly clogged and so forth when a hydrofluorocarbon type, a fluorocarbon type, a hydrocarbon type, an ether type, a carbon dioxide type or an ammonia type, preferably a hydrofluorocarbon type which can be a substitute for a chlorofluocarbon type refrigerant problematic due to the environmental pollution is used as a refrigerant.

BACKGROUND OF THE INVENTION

Generally, a compression-type refrigerating machine comprises at least a compressor, a condenser, an expansion mechanism (expansion valve and the like), an evaporator and further a drier, having a structure that a mixed liquid of a refrigerant and lubricating oil is circulated in this closed system. As a refrigerant of a compression-type refrigerating machine, especially, an air-conditioner, chlorodifluoromethane (hereinafter referred to as R22) or a mixture of chlorodifluoromethane and chloropentafluoroethane at a weight ratio of 48.8:51.2 (hereinafter referred to as R502) has been of ten used so far. Further, as lubricating oil, various mineral oils or synthetic oils that meet the above-described requirements have been used. However, since there is a fear that R22 and R502 might cause the environmental pollution such as the depletion of the ozonosphere present in the stratosphere or the like, they are being strictly regulated worldwide. For this reason, hydrofluorocarbons typified by 1,1,1,2-tetrafluoroethane, difluoromethane, pentafluoroethane and 1,1,1-trifluoroethane (hereinafter referred to as R134a, R32, R125 and R143a respectively) have attracted much interest as new refrigerants, and are replacing the same. Since there is no fear that these hydrofluorocarbons, especially R134a, R32, R125 and R143a might deplete the ozonosphere, they are preferable as a refrigerant for a compression-type refrigerating machine. Nevertheless, it is problematic when the hydrofluorocarbons are used singly. For example, in "Energy-Resources", vol. 16, No. 5, p. 474, it is reported that (1) when R134a is applied to an air-conditioner as a substitute for R22, an operating pressure is low, and an ability is decreased by approximately 40% and an efficiency by approximately 5% as compared with R22, (2) in comparison with R22, R32 is good in efficiency, but an operating pressure is high and a slight combustibility is shown , (3) R125 is incombustible, but a critical pressure is low and an efficiency is decreased, and so forth. Further, R143a is, like R32, problematic in a combustibility.

It is preferable that the refrigerant for the compression-type refrigerating machine can be used without changing the existing refrigerating machine. However, in view of the foregoing problems, a refrigerant containing the above-described hydrofluorocarbon has to be actually used. That is, in order to substitute existing refrigerants R22 and R502, it is advisable that combustible R32 and R143a are used from the aspect of the efficiency and the former is mixed with R125 and R134a for imparting an incombustibility to the entire refrigerant. In The International Symposium on R22 & R502 Alternative Refrigerants, 1994, p. 166, it is indicated that an R32/R134a mixture is combustible with the R32 content of 56% by weight or more. It is said that a refrigerant containing 45% by weight or more of an incombustible hydrofluorocarbon such as R125, R134a or the like is preferable from the aspect of the incombustibility, which cannot absolutely be defined though in view of the refrigerant composition.

Meanwhile, since a refrigerant is used under various conditions within a refrigerating system, it is undesirable that compositions of hydrofluorocarbons to be mixed vary greatly in respective positions of the refrigerating system. A refrigerant takes both gaseous and liquid forms in the refrigerating system. Accordingly, when boiling points of hydrofluorocarbons to be mixed are quite different, there is a possibility that compositions of mixing refrigerants vary greatly in respective positions of the refrigerating system for the foregoing reason.

The boiling points of R32, R143a, R125 and R134a are −51.7° C., −47.4° C., −48.5° C. and −26.3° C. respectively. When R134a is used in a hydrofluorocarbon-containing refrigerant system, care must be taken in this respect. Accordingly, in a refrigerant containing R125, its content is between 20 and 80% by weight, especially preferably between 40 and 70% by weight. When the content is less than 20% by weight, a large amount of a refrigerant having quite a different boiling point, such as R134a or the like, is further required to impart an incombustibility, which is undesirable in view of the foregoing reason. Further, when the content of R125 exceeds 80% by weight, an efficiency is decreased. Thus, it is unwanted.

In view of these points, as a substitute for the existing R22 refrigerant, a mixture of R32, R125 and R134a at a weight ratio of 23:25:52 (hereinafter referred to as R407C), a mixture thereof at a weight ratio of 25:15:60, a mixture of R32 and R125 at a weight ratio of 50:50 (hereinafter referred to as R410A), and a mixture of R32 and R125 at a weight ratio of 45:55 (hereinafter referred to as R410B) are preferable. Meanwhile, as a substitute for the R502 refrigerant, a mixture of R125, R143a and R134a at a weight ratio of 44:52:4 (hereinafter referred to as R404A) and a mixture of R125 and R143a at a weight ratio of 50:50 (hereinafter referred to as R507) are preferable.

This hydrofluorocarbon refrigerant is different from ordinary refrigerants in qualities. As refrigerating machine oil used in combination with this, a product obtained by using, for example, a polyalkylene glycol, a polyol ester, a polyvinyl ether or the like having a specific structure as base oil and adding thereto additives such as an antioxidant, an extreme pressure agent, a defoamer and the like is known to be useful.

On the other hand, in a refrigerating machine, an expansion valve called a capillary tube is provided in a refrigerating cycle. Since this capillary tube is a narrow tube having a diameter of approximately 0.7 mm, it tends to clog. The clogging phenomenon of the capillary tube is the most serious factor to determine the life of the refrigerating cycle. However, owing to the use of the additives, sludges were accumulated, and these caused the clogging of the capillary tube. Accordingly, the development of additives for dissolving materials that clog the capillary has been expected, and the advent of a refrigerating oil composition containing the same has been in demand.

DISCLOSURE OF THE INVENTION

The invention has been made from these aspects, and it aims to provide a refrigerating machine oil composition by which a capillary tube is hardly clogged when a hydrofluorocarbon type, a hydrocarbon type, an ether type, a carbon dioxide type or an ammonia type, preferably a hydrofluorocarbon type which can be a substitute for a chlorofluocarbon type refrigerant problematic due to the environmental pollution is used as a refrigerant.

The present inventors have assiduously conducted investigations, and have consequently found that the aim of the invention can effectively be achieved by mixing base oil containing oxygen-containing synthetic oil such as a polyvinyl ether or a polyol ester with a specific polyalkylene glycol alkyl ether or alkylbenzene. This has led to the completion of the invention.

That is, the gist of the invention is as follows.

First Invention (1) A refrigerating machine oil composition characterized in that a base oil containing at least one oxygen-containing synthetic oil selected from the group consisting a polyvinyl ether and a polyol ester is mixed with 1 to 20% by weight, based on the total amount of the composition, of a polyalkylene glycol alkyl ether having a number average molecular weight of 500 to 3,000, as represented by the following general formula (I) or (II)

$$R^1—O—(EO)_m(PO)_n—R^2 \quad (I)$$

$$R^1—O—(EO)_m(BO)_n—R^2 \quad (II)$$

(wherein EO represents an oxyethylene group, PO represents an oxypropylene group, BO represents an oxybutylene group, m and n each represent a positive number that satisfies the molecular weight, and $R^1$ and $R^2$ each represent hydrogen or an alkyl group with 1 to 10 carbon atoms, provided $R^1$ and $R^2$ may be the same but are not hydrogens at the same time).

(2) A refrigerating machine oil composition characterized in that base oil containing a polyvinyl ether copolymer comprising a structural unit (A) represented by the following general formula (XVII)

(XVII)

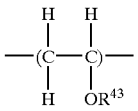

(wherein $R^{43}$ represents a hydrocarbon group with 1 to 3 carbon atoms having or not having an ether linkage in a molecule)

and/or a structural unit (B) represented by the following general formula (XVIII)

(XVIII)

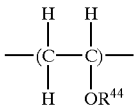

(wherein $R^{44}$ represents a hydrocarbon group with 3 to 20 carbon atoms having or not having an ether linkage in a molecule)

[provided $R^{43}$ of the structural unit (A) and $R^{44}$ of the structural unit (B) are not the same]

is mixed with 1 to 20% by weight, based on the total amount of the composition, of a polyalkylene glycol alkyl ether having a number average molecular weight of 500 to 3,000, as represented by the following general formula (I) or (II)

$$R^1—O—(EO)_m(PO)_n—R^2 \quad (I)$$

$$R^1—O—(EO)_m(BO)_n—R^2 \quad (II)$$

(wherein EO represents an oxyethylene group, PO represents an oxypropylene group, BO represents an oxybutylene group, m and n each represent a positive number that satisfies the molecular weight, and $R^1$ and $R^2$ each represent hydrogen or an alkyl group with 1 to 10 carbon atoms, provided $R^1$ and $R^2$ may be the same but are not hydrogens at the same time).

Second Invention (3) A refrigerating machine oil composition characterized in that a base oil containing at least one oxygen-containing synthetic oil selected from the group consisting of a polyvinyl ether and a polyol ester is mixed with 1 to 40% by weight, based on the total amount of the composition, of an alkylbenzene having a number average molecular weight of 100 to 1,000.

(4) A refrigerating machine oil composition characterized in that base oil containing a polyvinyl ether copolymer comprising a structural unit (A) represented by the following general formula (XVII)

(XVII)

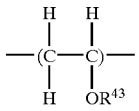

(wherein $R^{43}$ represents a hydrocarbon group with 1 to 3 carbon atoms having or not having an ether linkage in a molecule)

and/or a structural unit (B) represented by the following general formula (XVIII)

(XVIII)

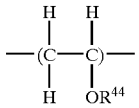

(wherein $R^{44}$ represents a hydrocarbon group with 3 to 20 carbon atoms having or not having an ether linkage in a molecule)

[provided $R^{43}$ of the structural unit (A) and $R^{44}$ of the structural unit (B) are not the same]

is mixed with 1 to 40% by weight, based on the total amount of the composition, of an alkylbenzene having a number average molecular weight of 100 to 1,000.

BEST MODE FOR CARRYING OUT THE INVENTION

The mode for carrying out the invention is described below.

First, in the refrigerating machine oil composition of the invention, oxygen-containing synthetic oil selected from a polyvinyl ether and a polyol ester is used as base oil. The viscosity of this synthetic oil is not particularly limited. The kinematic viscosity at 40° C. is between 2 and 500 $mm^2/s$, preferably between 5 and 200 $mm^2/s$, more preferably between 10 and 100 $mm^2/s$. Further, the pour point, an index of a low-temperature fluidity of this base oil is not particularly limited. It is preferably −10° C. or less. The oxygen-containing synthetic oil will be described last in detail.

Next, a polyalkylene glycol alkyl ether and an alkylbenzene to be mixed with the base oil is described.

The polyalkylene glycol alkyl ether which is an additive of the first invention of the application has a number average molecular weight of 500 to 3,000, and is represented by the general formula (I) or (II).

In the general formula (I) or (II), $R^1$ and $R^2$ are each hydrogen or an alkyl group with 1 to 10 carbon atoms. This alkyl group may be linear or branched. Specific examples of the alkyl group can include methyl, ethyl, n-propyl, isopropyl, various butyl, various pentyl, various hexyl, various heptyl, various octyl, various nonyl and various decyl groups. When the number of carbon atoms of this alkyl group exceeds 10, the solubility in base oil is poor. Thus, it is undesirable. The preferable number of carbon atoms of the alkyl group is between 1 and 6. The more preferable number of carbon atoms of the alkyl group is 3 or 4. Incidentally, $R^1$ and $R^2$ may be the same, but are not hydrogens at the same time. Further, a polyalkylene glycol monoalkyl ether in which one of $R^1$ and $R^2$ is hydrogen is especially preferable. In this case, $R^1$ or $R^2$ is preferably a propyl group or a butyl group.

In the general formula (I) or (II), EO and PO or EO and BO may be in a random form or in a block form. Further, m and n are each a positive number that satisfies the molecular weight, and an m/n ratio is preferably in the range of 5/95 to 40/60.

In the invention, the number average molecular weight of the polyalkylene glycol alkyl ether represented by the general formula (I) or (II) has to be between 500 and 3,000. When it is less than 500, the volume resistivity is decreased, and the electrical insulation properties are worsened. Further, when it exceeds 3,000, the compatibility with the refrigerant is decreased. Thus, it is undesirable. It is preferably between 800 and 2,000. Still further, the molecular weight distribution is preferably 200 to 10,000. Furthermore, the kinematic viscosity at 40° C. is preferably between 10 and 200 $mm^2/s$, more preferably between 30 and 100 $mm^2/s$.

In the refrigerating oil composition of the first invention of the application, the polyalkylene glycol alkyl ethers may be used either singly or in combination. Further, the mixing amount thereof is between 1 and 20% by weight based on the total amount of the composition. When this mixing amount is less than 1% by weight, the aim of the invention is not achieved satisfactorily. When it exceeds 20% by weight, the volume resistivity is decreased, and the electrical insulation properties are worsened. The preferable mixing amount is in the range of 2 to 15% by weight.

The alkylbenzene, the additive of the second invention of the application is then described.

With respect to the alkylbenzene, the structure is not particularly limited so long as the number average molecular weight is between 100 and 1,000. When the number average molecular weight is less than 100, the effect of preventing the clogging of the capillary is low. When it exceeds 1,000, the compatibility with the refrigerant is decreased. Thus, it is undesirable. Further, the molecular weight distribution is preferably between 500 and 3,000. Still further, the kinematic viscosity at 40° C. is preferably between 2 and 100 $mm^2/s$, more preferably between 5 and 70 $mm^2/s$.

With respect to the structure of the alkylbenzene, a compound having 1 to 4 alkyl groups with 4 to 20 carbon atoms is preferable. Specific examples of the alkyl group can include methyl, ethyl, n-propyl, isopropyl, various butyl, various pentyl, various hexyl, various heptyl, various octyl, various nonyl, various decyl, various undecyl, various dodecyl, various tridecyl, various tetradecyl, various pentadecyl, various hexadecyl, various heptadecyl, various octadecyl, various nonadecyl and eicosyl groups. The alkyl group may be linear or branched. In view of the stability, the viscosity characteristics and the like, the branched alkyl group is preferable. Especially in view of the availability, a branched alkyl group derived from an oligomer such as propylene, butene, isobutylene or the like is more preferable. The number of the alkyl groups of the alkylbenzene is preferably 1 to 4, and an alkylbenzene having 1 or 2 alkyl groups, namely, a monoalkylbenzene, a dialkylbenzene or a mixture thereof is used most preferably in view of the stability and the availability.

In the refrigerating machine oil composition of the second invention of the application, the alkylbenzenes may be used either singly or in combination. Further, the mixing amount thereof is between 1 and 40% by weight based on the total amount of the composition. When the mixing amount is less than 1% by weight, the aim of the invention is not achieved satisfactorily. When it exceeds 40% by weight, the effect is not so improved in spite of this large amount, and the compatibility with the refrigerant is decreased. The preferable mixing amount is in the range of 5 to 35% by weight.

The refrigerating machine oil composition of the invention can contain, as required, various known additives, for example, extreme pressure agents such as a phosphate ester, a phosphite ester and the like; phenolic and amine antioxidants; further acid trapping agents such as phenyl glycidyl ether, cyclohexene oxide, an epoxy compound, for example, epoxidized soybean oil and the like; copper inactivating agents such as benzotriazole, benzotriazole derivatives and the like; and defoamers such as silicone oil, fluorinated silicone oil and the like. The mixing amount of each of the additives is between 0.01 and 2% by weight based on the total amount of the refrigerating machine oil composition.

As the refrigerant used in the refrigerating machine to which the refrigerating machine oil composition of the invention is applied, a hydrofluorocarbon-type, fluorocarbon-type, hydrocarbon-type, ether-type, carbon dioxide-type or ammonia-type refrigerant is used. Of these, a hydrofluorocarbon-type refrigerant is preferable. As this hydrofluorocarbon-type refrigerant, for example, 1,1,2-tetrafluoroethane (R134a), difluoromethane (R32), pentafluoroethane (R125) and 1,1,1-trifluoroethane (R143a) are preferable. They may be used either singly or in combination. There is no fear that these hydrofluorocarbons might deplete the ozonosphere, and they are preferable as the refrigerant for the compression refrigerating machine. Further, examples of the mixed refrigerant include a mixture of R32, R125 and R134a at a weight ratio of 23:25:52 (hereinafter referred to as R407C), a mixture thereof at a weight ratio of 25:15:60, a mixture of R32 and R125 at a weight ratio of 50:50 (hereinafter referred to as R410A), a mixture of R32 and R125 at a weight ratio of 45:55 (hereinafter referred to as R410B), a mixture of R125, R143a and R134a at a weight ratio of 44:52:4 (hereinafter referred to as R404A), a mixture of R125 and R143a at a weight ratio of 50:50 (hereinafter referred to as R507) and the like.

Finally, the oxygen-containing synthetic oil used as the base oil of the refrigerating machine oil composition of the invention is described in detail.

The polyvinyl ether includes, for example, a polyvinyl ether compound (1) represented by the general formula (III)

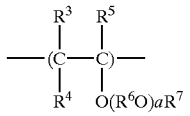

(III)

(wherein $R^3$ to $R^5$ each represent a hydrogen atom or a hydrocarbon group with 1 to 8 carbon atoms, they may be same or different, $R^6$ represents a divalent hydrocarbon group with 1 to 10 carbon atoms or an ether-linkage-oxygen-containing divalent hydrocarbon group with 2 to 20 carbon atoms, $R^7$ represents a hydrocarbon group with 1 to 20 carbon atoms, a represents is a number with the average value of 0 to 10, $R^3$ to $R^7$ may be the same or different in each structural unit, and when there are plural $R^6O$'s, plural $R^6O$'s may be the same or different).

Further, a polyvinyl ether compound (2) made of a block or random copolymer having the structural unit represented by the general formula (III) and a structural unit represented by the following general formula (IV)

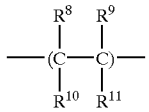

(IV)

(wherein $R^8$ to $R^{11}$ each represent a hydrogen atom or a hydrocarbon group with 1 to 20 carbon atoms, they may be the same or different, and $R^8$ to $R^{11}$ may be the same or different in each structural unit)

can be used. Still further, a polyvinyl ether compound (3) made of a mixture of the polyvinyl ether compound (1) and the polyvinyl ether compound (2) can also be used. $R^3$ to $R^5$ in the general formula (III) each represent a hydrogen atom or a hydrocarbon group with 1 to 8 carbon atoms, preferably with 1 to 4 carbon atoms. Examples of the hydrocarbon group here referred to can include alkyl groups such as methyl, ethyl, n-propyl, isopropyl, various butyl, various pentyl, various hexyl, various heptyl and various octyl groups, cycloalkyl groups such as cyclopentyl, cyclohexyl, various methylcyclohexyl, various ethylcyclohexyl and various dimethylcyclohexyl groups, aryl groups such as phenyl, various methylphenyl, various ethylphenyl and various dimethylphenyl groups, and arylalkyl groups such as benzyl, various phenylethyl and various methylbenzyl groups. By the way, as these $R^3$ to $R^5$, a hydrogen atom is especially preferable.

On the other hand, $R^6$ in the general formula (II) represents a divalent hydrocarbon group with 1 to 10 carbon atoms, preferably with 2 to 10 carbon atoms or an ether-linkage-oxygen-containing divalent hydrocarbon group with 2 to 20 carbon atoms. Specific examples of the divalent hydrocarbon group with 1 to 10 carbon atoms here can include divalent aliphatic groups such as methylene, ethylene, phenylethylene, 1,2-propylene, 2-phenyl-1,2-propylene, 1,3-propylene, various butylene, various pentylene, various hexylene, various heptylene, various octylene, various nonylene and various decylene groups; alicyclic groups in which 2 bonding sites are present in alicyclic hydrocarbons such as cyclohexane, methylcyclohexane, ethylcyclohexane, dimethylcyclohexane, propylcyclohexane and the like; divalent aromatic hydrocarbon groups such as various phenylene, various methylphenylene, various ethylphenylene, various dimethylphenylene and various naphthylene groups and the like; alkyl aromatic groups in which monovalent bonding sites are present respectively in an alkyl moiety and an aromatic moiety of alkyl aromatic hydrocarbons such as toluene, xylene, ethylbenzene and the like; alkyl aromatic groups in which a bonding site is present in an alkyl group moiety of polyalkyl aromatic hydrocarbons such as xylene, diethylbenzene and the like; and so forth. Of these, aliphatic groups with 2 to 4 carbon atoms are especially preferable.

Moreover, specific preferable examples of the ether-linkage-oxygen-containing divalent hydrocarbon group with 2 to 20 carbon atoms can include a methoxymethylene group; a methoxyethylene group; a methoxymethylene group; a 1,1-bismethoxymethylethylene group; a 1,2-bismethoxymethylethylene group; an ethoxymethylethylene group; a (2-methoxyethoxy)methylethylene group; a (1-methyl-2-methoxy)methylene group; and the like. By the way, a in the general formula (II) represents the number of $R^6O$ recurring units, and the average value thereof is between 0 and 10, preferably between 0 and 5. When there are plural $R^6O$'s, plural $R^6O$'s may be the same or different.

In addition, $R^7$ in the general formula (III) represents a hydrocarbon group with 1 to 20 carbon atoms, preferably 1 to 10 carbon atoms. Specific examples of the hydrocarbon group include alkyl groups such as methyl, ethyl, n-propyl, isopropyl, various butyl, various pentyl, various hexyl, various heptyl, various octyl, various nonyl and various decyl groups, cycloalkyl groups such as cyclopentyl, cyclohexyl, various methylcyclohexyl, various ethylcyclohexyl, various propylcyclohexyl and various dimethylcyclohexyl groups, aryl groups such as phenyl, various methylphenyl, various ethylphenyl, various dimethylphenyl, various propylphenyl, various trimethylphenyl, various butylphenyl and various naphthyl groups, arylalkyl groups such as benzyl, various phenylethyl, various methylbenzyl, various phenylpropyl and various phenylbutyl groups, and the like.

This polyvinyl ether compound (1) has the structural unit represented by the general formula (III). The number of the recurring units (degree of polymerization) can be selected, as required, depending on the desired viscosity. Further, with respect to the polyvinyl ether compound, a compound having the carbon/oxygen molar ratio of 4.2 to 7.0 is preferable. When the molar ratio is less than 4.2, the moisture absorption is sometimes increased. When it exceeds 7.0, the compatibility with the refrigerant is sometimes decreased.

Moreover, the polyvinyl ether compound (2) is made of the block or random copolymer comprising the structural unit represented by the general formula (III) and the structural unit represented by the general formula (IV). In the general formula (IV), $R^8$ to $R^{11}$ each represent a hydrogen atom or a hydrocarbon group with 1 to 20 carbon atoms, and they may be the same or different. Examples of the hydrocarbon group with 1 to 20 carbon atoms here can include the same as shown in the description of $R^7$ in the general formula (III). By the way, $R^8$ to $R^{11}$ may be the same or different in each structural unit.

The degree of polymerization of the polyvinyl ether compound (2) made of the block or random copolymer comprising the structural unit represented by the general formula (III) and the structural unit represented by the general formula (IV) can be selected, as required, according to the desired viscosity. Further, the carbon/oxygen molar ratio of this polyvinyl ether compound is preferably in the range of 4.2 to 7.0. When this molar ratio is less than 4.2, the moisture absorption is sometimes increased. When it exceeds 7.0, the compatibility with the refrigerant is sometimes decreased.

Besides, the polyvinyl ether compound (3) is made of the mixture of the polyvinyl ether compound (1) and the polyvinyl ether compound (2). The mixing amounts thereof are not particularly limited.

The polyvinyl ether compounds (1) and (2) used in the invention can be produced by the polymerization of each corresponding vinyl ether monomer, and the copolymerization of the corresponding hydrocarbon monomer having the olefinic double bond and the corresponding vinyl ether monomer. The vinyl ether monomer which can be used here is represented by the following general formula (V)

(V)

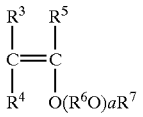

(wherein $R^3$ to $R^7$ and a are as defined above). This vinyl ether monomer includes various monomers corresponding to the polyvinyl ether compounds (1) and (2). Examples thereof include vinylmethyl ether; vinylethyl ether; vinyl-n-propyl ether; vinylisopropyl ether: vinyl-n-butyl ether; vinylisobutyl ether; vinyl-sec-butyl ether; vinyl-tert-butyl ether; vinyl-n-pentyl ether; vinyl-n-hexyl ether; vinyl-2-methoxyethyl ether; vinyl-2-ethoxyethyl ether; vinyl-2-methoxy-1-methylethyl ether; vinyl-2-methoxy-2-methyl ether; vinyl-3,6-dioxaheptyl ether; vinyl-3,6,9-trioxadecyl ether; vinyl-1,4-dimethyl-3,6-dioxaheptyl ether; vinyl-1,4,7-trimethyl-3,6,9-trioxadecyl ether; vinyl-2,6-dioxa-4-heptyl ether; vinyl-2,6,9-trioxa-4-decylether; 1-methoxypropene; 1-ethoxypropene; 1-n-propoxypropene; 1-isopropoxypropene; 1-n-butoxypropene; 1-isobutoxypropene; 1-sec-butoxypropene; 1-tert-butoxypropene; 2-methoxypropene; 2-ethoxypropene; 2-n-propoxypropene; 2-isopropoxypropene; 2-n-butoxypropene; 2-isobutoxypropene; 2-sec-butoxypropene; 2-tert-butoxypropene; 1-methoxy-1-butene; 1-ethoxy-1-butene; 1-n-propoxy-1-butene; 1-isopropoxy-1-butene; 1-n-butoxy-1-butene; 1-isobutoxy-1-butene; 1-sec-butoxy-1-butene; 1-tert-butoxy-1-butene; 2-methoxy-1-butene; 2-ethoxy-1-butene; 2-n-propoxy-1-butene; 2-isopropoxy-1-butene; 2-n-butoxy-1-butene; 2-isobutoxy-1-butene; 2-sec-butoxy-1-butene; 2-tert-butoxy-1-butene; 2-methoxy-2-butene; 2-ethoxy-2-butene; 2-n-propoxy-2-butene; 2-isopropoxy-2-butene; 2-n-butoxy-2-butene; 2-isobutoxy-2-butene; 2-sec-butoxy-2-butene; 2-tert-butoxy-2-butene; and the like.

These vinyl ether monomers can be produced by a known method.

Further, a hydrocarbon monomer having an olefinic double bond is represented by the following general formula (VI)

(VI)

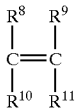

(wherein $R^8$ to $R^{11}$ are as defined above).

Examples of this monomer can include ethylene, propylene various butenes, various pentenes, various hexenes, various heptenes, various octenes, diisobutylene, triisobutylene, styrene, various alkyl-substituted styrenes and the like.

Preferable examples of the polyvinyl ether compound used in the invention include compounds having the following end structures, namely a structure that one end thereof is represented by the general formula (VII) or (VIII)

(VII)

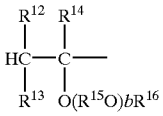

(VIII)

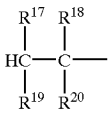

(wherein $R^{12}$ to $R^{14}$ each represent a hydrogen atom or a hydrocarbon group with 1 to 8 carbon atoms, $R^{12}$ to $R^{14}$ may be the same or different, $R^{17}$ to $R^{20}$ each represent a hydrogen atom or a hydrocarbon group with 1 to 20 carbon atoms, $R^{17}$ to $R^{20}$ may be the same or different, $R^{15}$ represents a divalent hydrocarbon group with 1 to 10 carbon atoms or an ether-linkage-oxygen-containing divalent hydrocarbon group with 2 to 20 carbon atoms, $R^{16}$ represents a hydrocarbon group with 1 to 20 carbon atoms, b represents a number with the average value of 0 to 10, and when there are plural $R^{15}O$'s, plural $R^{15}O$'s may be the same or different)

and the remaining end is represented by the general formula (IX) or (X)

(IX)

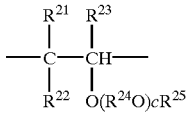

(X)

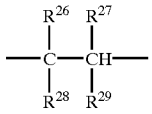

(wherein $R^{21}$ to $R^{23}$ each represent a hydrogen atom or a hydrocarbon group with 1 to 8 carbon atoms, $R^{21}$ to $R^{23}$ may be the same or different, $R^{26}$ to $R^{29}$ each represent a hydrogen atom or a hydrocarbon group with 1 to 20 carbon atoms, $R^{26}$ to $R^{29}$ may be the same or different, $R^{24}$ represents a divalent hydrocarbon group with 1 to 10 carbon atoms or an ether-linkage-oxygen-containing divalent hydrocarbon group with 2 to 20 carbon atoms, $R^{25}$ represents a hydrocarbon group with 1 to 20 carbon atoms, c represents a number with the average value of 0 to 10, and when there are plural $R^{24}O$'s, plural $R^{24}O$'s may be the same or different), and one end thereof is represented by the general formula (VII) or (VIII) and the remaining end is represented by the general formula (XI)

(XI)

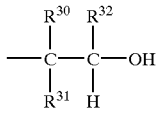

(wherein $R^{30}$ to $R^{32}$ each represent a hydrogen atom or a hydrocarbon group with 1 to 8 carbon atoms, and they may be the same or different).

Among these polyvinyl ether compounds, the following compounds are especially preferable as base oil of the refrigerating machine oil composition of the invention.

(1) A compound having a structure that one end thereof is represented by the general formula (VII) or (VIII) and the remaining end is represented by the general formula (IX) or (X), in which in the general formula (III), $R^3$ to $R^5$ are both hydrogen atoms, a is a number of 0 to 4, $R^6$ is a divalent hydrocarbon group with 2 to 4 carbon atoms and $R^7$ is a hydrocarbon group with 1 to 20 carbon atoms.

(2) A compound comprising only a structural unit represented by the general formula (III) and having a structure that one end thereof is represented by the general formula (VII) and the remaining end is represented by the general formula (IX), in which in the general formula (III), $R^3$ to $R^5$ are both hydrogen atoms, a is a number of 0 to 4, $R^6$ is a divalent hydrocarbon group with 2 to 4 carbon atoms and $R^7$ is a hydrocarbon group with 1 to 20 carbon atoms.

(3) A compound having a structure that one end thereof is represented by the general formula (VII) or (VIII) and the remaining end is represented by the general formula (XI), in which in the general formula (III), $R^3$ to $R^5$ are both hydrogen atoms, a is a number of 0 to 4, $R^6$ is a divalent hydrocarbon group with 2 to 4 carbon atoms and $R^7$ is a hydrocarbon group with 1 to 20 carbon atoms.

(4) A compound comprising only a structural unit represented by the general formula (III) and having a structure that one end thereof is represented by the general formula (VII) and the remaining end is represented by the general formula (X), in which in the general formula (III), $R^3$ to $R^5$ are both hydrogen atoms, a is a number of 0 to 4, $R^6$ is a divalent hydrocarbon group with 2 to 4 carbon atoms and $R^7$ is a hydrocarbon group with 1 to 20 carbon atoms.

Further, in the invention, a polyvinyl ether compound comprising a structural unit represented by the general formula (III) and having a structure that one end thereof is represented by the general formula (VII) and the remaining end is represented by the general formula (XII)

(XII)

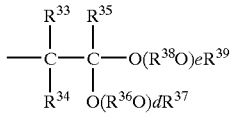

(wherein $R^{33}$ to $R^{35}$ each represent a hydrogen atom or a hydrocarbon group with 1 to 8 carbon atoms, they may be the same or different, $R^{36}$ and $R^{38}$ each represent a divalent hydrocarbon group with 2 to 10 carbon atoms, they may be the same or different, $R^{37}$ and $R^{39}$ each represent a hydrocarbon group with 1 to 10 carbon atoms, they may be the same or different, d and e each represent a number with the average value of 0 to 10, they may be the same or different, when there are plural $R^{36}O$'s, plural $R^{36}O$'s may be the same or different, and when there are plural $R^{38}O$'s, plural $R^{38}O$'s may be the same or different)

is also available.

Moreover, in the invention, a polyvinyl ether compound made of a homopolymer or a copolymer of an alkylvinyl ether comprising a structural unit represented by the following general formula (XIII) or (XIV)

(XIII)

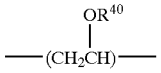

(XIV)

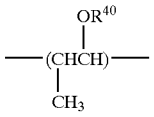

(wherein $R^{40}$ represents a hydrocarbon group with 1 to 8 carbon atoms), having a weight average molecular weight of 300 to 3,000 (preferably 300 to 2,000) and having a structure that one end is represented by the general formula (XV) or (XVI)

(XV)

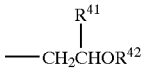

(XVI)

(wherein $R^{41}$ represents an alkyl group with 1 to 3 carbon atoms, and R represents a hydrocarbon group with 1 to 8 carbon atoms)

is also available.

In addition, a polyvinyl ether copolymer comprising a structural unit (A) represented by the following general formula (XVII)

(XVII)

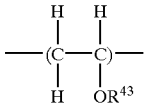

(wherein $R^{43}$ represents a hydrocarbon group with 1 to 3 carbon atoms having or not having an ether linkage in a molecule)

and a structural unit (B) represented by the following general formula (XVIII)

(XVIII)

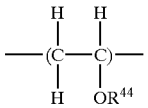

(wherein $R^{44}$ represents a hydrocarbon group with 3 to 20 carbon atoms having or not having an ether linkage in a molecule)

[provided $R^{43}$ of the structural unit (A) and $R^{44}$ of the structural unit (B) are not the same]

is used especially preferably. A compound in which $R^{43}$ is an alkyl group with 1 to 3 carbon atoms and $R^{44}$ is an alkyl group with 3 to 20 carbon atoms is more preferable. A polyvinyl ether copolymer in which $R^{43}$ is a methyl group or an ethyl group and $R^{44}$ is an alkyl group with 3 to 6 carbon atoms is especially preferable. Among others, a polyvinyl ether copolymer in which $R^{43}$ is an ethyl group and $R^{44}$ is an isobutyl group is most preferable. In this case, the ratio of the structural unit (A) to the structural unit (B) is preferably in the range of 95:5 to 50:50, more preferably in the range of 95:5 to 70:30 in terms of a molar ratio.

The polyvinyl ether compound can be produced by subjecting the monomer to radical polymerization, cationic polymerization, radiation polymerization or the like. For instance, the vinyl ether monomer is polymerized by the following method to obtain a polymer having a desired viscosity.

In the initiation of the polymer, a combination of Brφnsted acids, Lewis acids or organometallic compounds with water, alcohols, phenols, acetals or adducts of vinyl ethers and carboxylic acids can be used.

Examples of Brφnsted acids include hydrofluoric acid, hydrochloric acid, hydrobromic acid, hydroiodic acid, nitric acid, sulfuric acid, trichloroacetic acid, trifluoroacetic acid and the like. Examples of the Lewis acids include boron trifluoride, aluminum trichloride, aluminum tribromide, tin tetrachloride, zinc dichloride, ferric chloride and the like. Of these Lewis acids, boron trifluoride is especially preferable. Further, examples of the organometallic compounds include diethylaluminum chloride, ethylaluminum chloride, diethylzinc and the like.

Water, alcohols, phenols, acetals or adducts of vinyl ethers and carboxylic acids used in combination therewith can optionally be selected.

Examples of the alcohols here include saturated aliphatic alcohols with 1 to 20 carbon atoms, such as methanol, ethanol, propanol, isopropanol, butanol, isobutanol, sec-butanol, tert-butanol, various pentanols, various hexanols, various heptanols, various octanols and the like; unsaturated aliphatic alcohols with 3 to 10 carbon atoms, such as allyl alcohol and the like; and so forth.

Examples of the carboxylic acids in using the adducts of the vinyl ethers and the carboxylic acids include acetic acid; propionic acid; n-butyric acid; isobutyric acid; n-valeric acid; isovaleric acid; 2-methylbutyric acid; pivalic acid; n-caproic acid; 2,2-dimethylbutyric acid; 2-methylvaleric acid; 3-methylvaleric acid; 4-methylvaleric acid; enanthic acid; 2-methylcaproic acid; capric acid; 2-ethylcaproic acid; 2-n-propylvaleric acid; n-nonanoic acid; 3,5,5-trimethylcaproic acid; capric acid; undecanoic acid; and the like.

Further, the vinyl ethers may be the same as, or different from, those which are used in the polymerization. The adducts of the vinyl ethers and the carboxylic acids can be obtained by mixing both of them and reacting the mixture at a temperature of approximately 0 to 100° C., separated through distillation and used in the reaction. They can also be used as such in the reaction without being separated.

When water, alcohols or phenols are used, hydrogen is bound to the polymerization initiation end of the polymer. When acetals are used, hydrogen or one alkoxy group from acetals used is eliminated. Further, when adducts of vinyl ethers and carboxylic acids are used, an alkylcarbonyloxy group derived from a carboxylic acid moiety is eliminated from adducts of vinyl ethers and carboxylic acids.

On the other hand, when water, alcohols, phenols or acetals are used, the termination end is an acetal, an olefin or an aldehyde. Further, in case of adducts of vinyl ethers and carboxylic acids, it is a carboxylic acid ester of a hemiacetal.

The end of the thus-obtained polymer can be converted to a desired group by a known method. Examples of the desired group include residues such as saturated hydrocarbons, ethers, alcohols, ketones, nitrites, amides and the like. Residues such as saturated hydrocarbons, ethers and alcohols are preferable.

The polymerization of the vinyl ether monomer represented by the general formula (V) can be initiated at between −80 and 150° C., though it depends on the types of the starting material and the initiator. It can usually be conducted at a temperature in the range of −80 to 50° C. Further, the polymerization reaction is completed in 10 seconds to 10 hours from the initiation of the reaction.

With respect to the adjustment of the molecular weight in the polymerization reaction, a polymer having a low average molecular weight is obtained by increasing the amount of water, alcohols, phenols, acetals or adducts of vinyl ethers and carboxylic acids relative to the vinyl ether monomer represented by the general formula (V) Moreover, a polymer having a low average molecular weight is obtained by increasing the amount of the Brφnsted acids or the Lewis acids.

This polymerization reaction is usually conducted in the presence of a solvent. The solvent is not particularly limited so long as it dissolves a necessary amount of a reaction starting material and is inactive to the reaction. For example, hydrocarbon solvents such as hexane, benzene, toluene and the like, and ether solvents such as ethyl ether, 1,2-dimethoxyethane, tetrahydrofuran and the like can preferably be used. By the way, this polymerization reaction can be completed by adding an alkali. After the completion of the reaction, ordinary separation and purification methods are conducted as required to obtain a desired polyvinyl ether compound comprising a structural unit represented by the general formula (III).

In the polyvinyl ether compound used in the invention, the carbon/oxygen molar ratio is preferably in the range of 4.2 to 7.0 as described above. The polymer having the molar ratio in the foregoing range can be produced by adjusting the carbon/oxygen molar ratio of the starting monomer. That is, when an amount of a monomer having a high carbon/oxygen molar ratio is large, a polymer having a high carbon/oxygen molar ratio is obtained. When an amount of a monomer having a low carbon/oxygen molar ratio is large, a polymer having a low carbon/oxygen molar ratio is obtained.

Further, as described in the polymerization method of the vinyl ether monomer, it is also possible with a combination of water, alcohols, phenols, acetals or adducts of vinyl ethers and carboxylic acids used as an initiator and monomers. When alcohols, phenols and the like having a higher carbon/oxygen molar ratio than the monomer for polymerization are used as an initiator, a polymer having a higher carbon/oxygen molar ratio than the starting monomer is obtained. Meanwhile, when alcohols having a lower carbon/oxygen molar ratio, such as methanol, methoxyethanol and the like are used, a polymer having a lower carbon/oxygen molar ratio than the starting monomer is obtained.

Furthermore, when the vinyl ether monomer and the hydrocarbon monomer having the olefinic double bond are copolymerized, a polymer having a higher carbon/oxygen molar ratio than the carbon/oxygen molar ratio of the vinyl ether monomer is obtained. The ratio thereof can be adjusted by the ratio of the hydrocarbon monomer having the olefinic double bond or the number of carbon atoms.

The polyol ester includes a carboxylic acid ester of a polyhydric hydroxy compound containing at least two hydroxyl groups. For example, a compound represented by the general formula (XIX)

$$R^{45}[OCOR^{46}]_f \quad (XIX)$$

(wherein $R^{45}$ represents a hydrocarbon group, $R^{46}$ represents a hydrogen atom or a hydrocarbon group having 1 to 22 carbon atoms, f represents an integer of 2 to 6, and plural —$OCOR^{46}$'s may be the same or different) can be used.

In the general formula (XIX), $R^{45}$ represents a hydrocarbon group which may be linear or branched. Preferably, it is an alkyl group with 2 to 10 carbon atoms. $R^{46}$ is a hydrogen atom or a hydrocarbon group with 1 to 22 carbon atoms, and it is preferably an alkyl group with 2 to 16 carbon atoms.

The polyol ester represented by the general formula (XIX) can be obtained by reacting a polyhydric alcohol represented by the general formula (XX)

$$R^{45}(OH)_f \quad (XX)$$

(wherein $R^{45}$ and f are as defined above)
with a carboxylic acid represented by the general formula (XXI)

$$R^{46}COOH \quad (XXI)$$

(wherein $R^{46}$ is as defined above)
or its reactive derivatives such as its ester and acid halide and the like.

Examples of the polyhydric alcohol represented by the general formula (XX) can include ethylene glycol, propylene glycol, butylene glycol, neopentyl glycol, trimethylolethane, trimethylolpropane, glycerin, pentaerythritol, dipentaerythritol, sorbitol and the like. Meanwhile, examples of the carboxylic acid represented by (XXI) can include propionic acid, butyric acid, pivalic acid, valeric acid, caproic acid, heptanoic acid, 3-methylhexanoic acid, 2-ethylhexanoic acid, capric acid, pelargonic acid, caproic acid, lauric acid, myristic acid, palmitic acid, 2-methylhexanoic acid, 3-methyloctanoic acid, 3-methylheptanoic acid, 2-ethylheptanoic acid, 2-methylheptanoic acid, 2-methyloctanoic acid and the like.

The invention is illustrated more specifically below by referring to Examples.

EXAMPLE 1

A refrigerating machine oil composition was prepared by using a polyvinylethyl ether (a) ⅁polyisobutyl ether (b) random copolymer [a unit/b unit (molar ratio) =9/1, kinematic viscosity 68 $mm^2/s$ (40° C.), number average molecular weight 720, abbreviated as PVE] as base oil and incorporating 5% by weight, based on the total amount of the composition, of a polyoxybutylene (A) ⅁polyoxyethylene (B) glycol monobutyl ether random copolymer [A unit/B unit (molar ratio)=9/1, kinematic viscosity 68 $mm^2/s$ (40° C.), number average molecular weight 920, abbreviated as PAG1] as an additive. With respect to the composition, the flow rate decrease ratio of the capillary, the volume resistivity and the two-layer separation temperature were measured and evaluated by the following methods. The results are shown in Table 1.

[Method for Measuring a Flow Rate Decrease Ratio of a Capillary]

An actual evaluation apparatus comprising a compressor, a capillary and a double piping-type heat exchanger was charged with a refrigerating machine oil composition and a refrigerant (R407C), and operated for a predetermined period of time (1,000 hours). Before and after the test, the flow rate of the capillary with a nitrogen gas was measured, and the flow rate decrease ratio was obtained.

[Method for Measuring a Volume Resistivity]

Measured at 25° C. according to JIS C 2101.

Method for Measuring a Two-layer Separation Temperature (Refrigerant Compatibility)

Sample oil and a refrigerant (R410a) were encapsulated in a glass ampoule at an oil content of 10%. The temperature was progressively raised from room temperature, and a two-liquid interface of the sample oil and the refrigerant was visually observed. A temperature at which they were separated in cloudy state was defined as the two-layer separation temperature.

EXAMPLE 2

The evaluation was conducted as in Example 1 except that 5% by weight of a polyoxybutylene (A) ⅁polyoxyethylene (B) glycol monobutyl ether random copolymer [A unit/B unit (molar ratio)=8/2, kinematic viscosity 68 $mm^2/s$ (40° C.), number average molecular weight 950, abbreviated as PAG2] was used as an additive. The results are shown in Table 1.

EXAMPLE 3

The evaluation was conducted as in Example 1 except that 10% by weight of a polyoxybutylene (A) ⅁polyoxyethylene (B) glycol monobutyl ether random copolymer [A unit/B unit (molar ratio)=7/3, kinematic viscosity 68 $mm^2/s$ (40° C.), number average molecular weight 1,060, abbreviated as PAG3] was used as an additive. The results are shown in Table 1.

EXAMPLE 4

The evaluation was conducted as in Example 1 except that the amount of the additive was changed to 2% by weight based on the total amount of the composition. The results are shown in Table 1.

EXAMPLE 5

The evaluation was conducted as in Example 1 except that 30% by weight of an alkylbenzene 1 [hard monoalkylbenzene, number average molecular weight 250, kinematic viscosity 15 $mm^2/s$ (40° C.), abbreviated as AB1] was used as an additive. The results are shown in Table 1.

EXAMPLE 6

A refrigerating machine oil composition was prepared by using an ester (complete ester of pentaerythritol and a mixture of 2-methylheptanoic acid (50%) and 2-methyloctanoic acid (50%)) as base oil and incorporating 10% by weight, based on the total amount of the composition, of PAG1 as an additive. The composition was likewise evaluated. The results are shown in Table 1.

COMPARATIVE EXAMPLE 1

The evaluation was conducted as in Example 1 except that 10% by weight of a polyoxybutylene (A) polyoxyethylene (B) glycol monobutyl ether random copolymer [A unit/B unit (molar ratio)=9/1, kinematic viscosity 4 $mm^2/s$ (40° C.), number average molecular weight 300, abbreviated as PAG4] was used as an additive. The results are shown in Table 1.

COMPARATIVE EXAMPLE 2

The evaluation was conducted as in Example 1 except that 10% by weight of a polyoxybutylene (A) polyoxyethylene (B) glycol monobutyl ether random copolymer [A unit/B unit (molar ratio)=9/1, kinematic viscosity 320 $mm^2/s$ (40° C.), number average molecular weight 4,000, abbreviated as PAG5] was used as an additive. The results are shown in Table 1.

COMPARATIVE EXAMPLE 3

The evaluation was conducted as in Example 1 except that the amount of the additive was changed to 30% by weight based on the total amount of the composition. The results are shown in Table 1.

COMPARATIVE EXAMPLE 4

The evaluation was conducted as in Example 3 except that 50% by weight of an alkylbenzene 1 [hard monoalkylbenzene, number average molecular weight 250, kinematic viscosity 15 $mm^2/s$ (40° C.), abbreviated as AB1] was used as an additive. The results are shown in Table

COMPARATIVE EXAMPLE 5

The evaluation was conducted as in Example 1 except that 1% by weight of tricresyl phosphate (abbreviated as TCP) was used as an additive. The results are shown in Table 1.

COMPARATIVE EXAMPLE 6

The evaluation was conducted as in Example 1 except that the additive was not used. The results are shown in Table 1.

COMPARATIVE EXAMPLE 7

The evaluation was conducted as in Example 6 except that only the ester used in Example 6 was used. The results are shown in Table 1.

TABLE 1

| | Sample | Additive: Number average molecular weight | Additive: Mixing amount (wt. %) | Flow rate decrease ratio of capillary (%) | Volume resistivity (Ωcm) | Two-layer separation temperature (° C.) |
|---|---|---|---|---|---|---|
| Ex. 1 | PVE + PAG1 | 920 | 5 | 4.5 | 3.70E + 12 | −50° C. or less |
| Ex. 2 | PVE + PAG2 | 950 | 5 | 4.2 | 1.70E + 12 | −47 |
| Ex. 3 | PVE + PAG3 | 1,060 | 10 | 4.8 | 8.10E + 11 | −4 |
| Comp. Ex. 1 | PVE + PAG4 | 300 | 10 | 3.8 | 1.30E + 10 | −50° C. or less |
| Comp. Ex. 2 | PVE + PAG5 | 4,000 | 10 | 6.7 | 5.60E + 12 | separated at room temperature |
| Ex. 4 | PVE + PAG1 | 920 | 2 | 5.5 | 9.60E + 12 | −50° C. or less |
| Comp. Ex. 3 | PVE + PAG1 | 920 | 30 | 3.9 | 5.30E + 11 | −38 |
| Ex. 5 | PVE + AB1 | 250 | 30 | 2.8 | 7.30E + 13 | −24 |
| Comp. Ex. 4 | PVE + AB1 | 250 | 50 | 2.6 | 8.20E + 13 | separated at room temperature |
| Ex. 6 | Ester + PAG1 | 920 | 10 | 8.2 | 9.60E + 11 | −2 |
| Comp. Ex. 5 | PVE + TCP | — | 1 | 10.9 | 3.80E + 13 | −50° C. or less |
| Comp. Ex. 6 | PVE | — | 0 | 11.5 | 6.20E + 13 | −50° C. or less |
| Comp. Ex. 7 | Ester | — | 0 | 18.3 | 6.70E + 12 | −7 |

Industrial Applicability

The invention can provide a refrigerating machine oil composition by which a capillary tube is hardly clogged when a hydrofluorocarbon type, a hydrocarbon type, an ether type, a carbon dioxide type or an ammonia type, preferably a hydrofluorocarbon type which can be a substitute for a chlorofluorocarbon type refrigerant problematic due to the environmental pollution is used as a refrigerant.

What is claimed is:

1. A refrigerating machine oil composition comprising a base oil containing at least one oxygen-containing synthetic oil selected from the group consisting of a polyvinyl ether and a polyol ester and from 1 to 20% by weight, based on the total amount of the composition, of a polyalkylene glycol alkyl ether having a number average molecular weight of 500 to 3,000, as represented by the following general formula (I) or (II)

$$R^1—O—(EO)_m(PO)_n—R^2 \quad (I)$$

$$R^1—O—(EO)_m(BO)_n—R^2 \quad (II)$$

(wherein EO represents an oxyethylene group, PO represents an oxypropylene group, BO represents an oxybutylene group, m and n each represent a positive number that satisfies the molecular weight, and $R^1$ and $R^2$ each represent hydrogen or an alkyl group with 1 to 10 carbon atoms, provided $R^1$ and $R^2$ may be the same but are not hydrogens at the same time).

2. A refrigerating machine oil composition comprising a base oil containing a polyvinyl ether copolymer comprising a structural unit (A) represented by the following general formula (XVII)

(XVII)

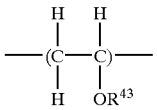

(wherein $R^{43}$ represents a hydrocarbon group with 1 to 3 carbon atoms having or not having an ether linkage in a molecule)

and/or a structural unit (B) represented by the following general formula (XVIII)

(XVIII)

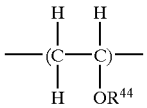

(wherein $R^{44}$ represents a hydrocarbon group with 3 to 20 carbon atoms having or not having an ether linkage in a molecule)

provided $R^{43}$ of the recurring unit (A) and $R^{44}$ of the recurring unit (B) are not the same and from 1 to 20% by weight, based on the total amount of the composition, of a polyalkylene glycol alkyl ether having a number average molecular weight of 500 to 3,000, as represented by the following general formula (I) or (II)

$$R^1—O—(EO)_m(PO)_n—R^2 \quad (I)$$

$$R^1—O—(EO)_m(BO)_n—R^2 \quad (II)$$

(wherein EO represents an oxyethylene group, PO represents an oxypropylene group, BO represents an oxybutylene group, m and n each represent a positive number that satisfies the molecular weight, and $R^1$ and $R^2$ each represent hydrogen or an alkyl group with 1 to 10 carbon atoms, provided $R^1$ and $R^2$ may be the same but are not hydrogens at the same time).

3. A refrigerating machine oil composition comprising a base oil containing a polyol ester and from 1 to 40% by weight, based on the total amount of the composition, of an alkylbenzene having a number average molecular weight of 100 to 1,000.

4. A refrigerating machine oil composition comprising a base oil containing a polyvinyl ether copolymer comprising a structural unit (A) represented by the following general formula (XVII)

(XVII)

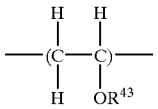

(wherein $R^{43}$ represents a hydrocarbon group with 1 to 3 carbon atoms having or not having an ether linkage in a molecule)

and/or a structural unit (B) represented by the following general formula (XVIII)

(XVIII)

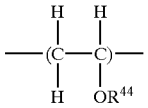

(wherein $R^{44}$ represents a hydrocarbon group with 3 to 20 carbon atoms having or not having an ether linkage in a molecule)

provided $R^{43}$ of the recurring unit (A) and $R^{44}$ of the recurring unit (B) are not the same and from 1 to 40% by weight, based on the total amount of the composition, of an alkylbenzene having a number average molecular weight of 100 to 1,000.

5. A refrigerating machine oil composition according to claim 4, wherein $R^{43}$ is an ethyl group and $R^{44}$ is an isobutyl group, and the molar ratio of the structural unit (A) to the structural unit (B) is in the range of 95:5 to 70:30.

* * * * *